US011560667B2

(12) United States Patent
Jung et al.

(10) Patent No.: US 11,560,667 B2
(45) Date of Patent: Jan. 24, 2023

(54) LAUNDRY TREATMENT APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 25 days.

(21) Appl. No.: 17/142,881

(22) Filed: Jan. 6, 2021

(65) Prior Publication Data

US 2021/0222344 A1 Jul. 22, 2021

(30) Foreign Application Priority Data

Jan. 21, 2020 (KR) ..... 10-2020-0007867

(51) Int. Cl.
*D06F 39/02* (2006.01)
*D06F 39/08* (2006.01)
(Continued)

(52) U.S. Cl.
CPC ..... *D06F 39/022* (2013.01); *D06F 23/02* (2013.01); *D06F 39/088* (2013.01); *D06F 39/12* (2013.01)

(58) Field of Classification Search
CPC ..... D06F 39/022; D06F 39/02; D06F 39/028; D06F 39/088; D06F 2105/42;
(Continued)

(56) References Cited

U.S. PATENT DOCUMENTS

2010/0000022 A1* 1/2010 Hendrickson ..... D06F 39/022 68/4
2010/0000581 A1* 1/2010 Doyle ..... D06F 39/028 134/99.2
(Continued)

FOREIGN PATENT DOCUMENTS

CN 102421958 4/2012
CN 103276564 9/2013
(Continued)

OTHER PUBLICATIONS

EP Extended European Search Report in European Appln. No. 21151505.1, dated Jul. 5, 2021, 5 pages.
(Continued)

*Primary Examiner* — David G Cormier
*Assistant Examiner* — Thomas Bucci
(74) *Attorney, Agent, or Firm* — Fish & Richardson P.C.

(57) ABSTRACT

A laundry treatment apparatus is disclosed, including a cabinet, a tub configured to store water, a drum rotatably disposed inside the tub, a drawer configured to be withdrawable from the cabinet, a housing including a housing body configured to accommodate the drawer and a cover configured to form an upper surface of the housing body, a storage portion including a storage body configured to store liquid detergent and a discharger disposed on the storage body, a supply pump including a connection pipe formed through the housing body, a supply pipe configured to connect the connection pipe and the tub body, and a conveyor portion configured to covey detergent to the supply pipe, a first pump fastener configured to fix an area located above the connection pipe to the cover, and a second pump fastener configured to fix an area located under the connection pipe to the housing body.

20 Claims, 7 Drawing Sheets

(51) Int. Cl.
*D06F 23/02* (2006.01)
*D06F 39/12* (2006.01)

(58) Field of Classification Search
CPC ..... D06F 39/12; A47L 15/0055; A47L 15/44; A47L 15/4418; A47L 15/449
USPC ..... 68/12.18
See application file for complete search history.

(56) References Cited

U.S. PATENT DOCUMENTS

2012/0096901 A1* 4/2012 Zattin ..... D06F 39/02 68/13 R
2012/0096903 A1* 4/2012 Kim ..... D06F 39/02 68/17 R
2012/0159997 A1 6/2012 Del Pos et al.
2012/0291916 A1* 11/2012 Hwang ..... C02F 1/686 141/311 R
2013/0312463 A1* 11/2013 Kim ..... D06F 39/022 222/173
2015/0114047 A1* 4/2015 Jung ..... D06F 39/022 68/17 R
2016/0177491 A1* 6/2016 Da Pont ..... D06F 39/02 222/135
2016/0201248 A1* 7/2016 Kim ..... G06F 3/041 68/17 R
2016/0258106 A1* 9/2016 Kim ..... D06F 39/022
2017/0073875 A1* 3/2017 Seo ..... D06F 39/028

FOREIGN PATENT DOCUMENTS

| | | |
|---|---|---|
| CN | 103422328 | 12/2013 |
| CN | 104894813 | 9/2015 |
| CN | 10693 9496 | 7/2017 |
| CN | 107385799 | 11/2017 |
| EP | 2735634 | 7/2016 |
| EP | 2868797 | 1/2017 |
| JP | 2013094203 | 5/2013 |
| WO | WO2019068337 | 4/2019 |

OTHER PUBLICATIONS

Notice of Allowance in Chinese Appln. No. 202011576557.1, dated Nov. 2, 2022, 10 pages (with English translation).

* cited by examiner

LAUNDRY TREATMENT APPARATUS

CROSS-REFERENCE TO RELATED APPLICATION

This application claims the benefit of Korean Patent Application No. 10-2020-0007867, filed on Jan. 21, 2020, which is hereby incorporated by reference as if fully set forth herein.

TECHNICAL FIELD

The present disclosure relates to a laundry treatment apparatus.

BACKGROUND

A laundry treatment apparatus conceptually includes an apparatus that washes laundry, an apparatus that dries laundry, and an apparatus that washes or dries laundry according to selection of a user. Some related art laundry treatment apparatuses include a cabinet, a tub provided within the cabinet to store water therein, a drum rotatably provided within the tub to store laundry therein, and a detergent storage portion storing detergent therein.

Some detergent storage portions included in the related art laundry treatment apparatuses include a drawer disposed to be withdrawable from the cabinet, a housing disposed inside the cabinet to accommodate the drawer, a storage portion disposed in the drawer to store liquid detergent, a supply pump disposed on the housing and detachably coupled to the storage portion, and a supply pipe guiding detergent discharged from the supply pump to the tub.

The detergent storage portion having the above-described structure has operated such that the supply pump is connected to the storage portion when the drawer is inserted into the housing, and detergent inside the housing is supplied to the tub through the supply pipe when the supply pump operates. In this detergent storage portion, since the supply pump and the storage portion are repeatedly coupled and separated according to the position of the drawer, the location of the supply pump may be changed or the supply pump may be damaged, if the supply pump is firmly fixed to the housing.

On the other hand, the detergent storage portion of the above-described structure fails to sense the amount of liquid detergent stored therein so that a user may not be informed of a replenishment timing of the liquid detergent.

SUMMARY

Accordingly, the present disclosure is directed to a laundry treatment apparatus that substantially obviates one or more problems due to limitations and disadvantages of the related art.

An object of the present disclosure is to provide a laundry treatment apparatus that improves durability of a supply pump detachably disposed on a storage body in which detergent is stored.

Another object of the present disclosure is to provide a laundry treatment apparatus capable of sensing the amount of liquid detergent stored in the storage body.

Another object of the present disclosure is to provide a laundry treatment apparatus capable of easily cleaning a means for sensing the amount of liquid detergent.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry treatment apparatus includes a cabinet including an introduction port and an exit port, a tub disposed inside the cabinet to store water, a drum rotatably disposed inside the tub, a drawer configured to be withdrawable from the cabinet through the exit port, a housing including a housing body configured to communicate with the exit port and to accommodate the drawer and a cover configured to form an upper surface of the housing body, a storage portion including a storage body configured to be detachable from the drawer to store liquid detergent and a discharger disposed on the storage body, a supply pump including a connection pipe formed through the housing body and connected to the discharger when the drawer is inserted into the housing, a supply pipe configured to connect the connection pipe and the tub body, and a conveyor portion configured to covey detergent inside the storage body to the supply pipe, a first pump fastener configured to fix an area located above the connection pipe, among areas of the supply pump, to the cover, and a second pump fastener configured to fix an area parallel to the connection pipe or an area located under the connection pipe, among the areas of the supply pump, to the housing body.

The first pump fastener may be configured to fix an area located above a horizontal line passing through the center of weight of the supply pump, among areas provided by the supply pump, to the cover, and the second pump fastener may be configured to fix an area located under the horizontal line, among the areas provided by the supply pump, to the housing body.

In accordance with an aspect of the present disclosure, a laundry treatment apparatus includes a cabinet including an introduction port and an exit port, a tub including a tub body disposed inside the cabinet to store water and a tub introduction port formed through the tub body to communicate with the introduction port, a drum including a drum body rotatably disposed inside the tub and a drum introduction port formed through the drum body to communicate with the tub introduction port, a drawer configured to be withdrawable from the cabinet through the exist port, a housing including a housing body configured to communicate with the exit port and to accommodate the drawer and a cover configured to form an upper surface of the housing body, a storage portion including a storage body configured to be detachable from the drawer to store liquid detergent, a discharger disposed on the storage body, and a discharge valve configured to open and close the discharger, a supply pump including a connection pipe formed through the housing body and connected to the discharger when the drawer is inserted into the housing, a supply pipe configured to connect the connection pipe and the tub body, and a conveyor portion configured to covey detergent inside the storage body to the supply pipe, a first pump fastener configured to fix an area located above the connection pipe, among areas of the supply pump, to the cover, and a second pump fastener configured to fix an area parallel to the connection pipe or an area located under the connection pipe, among the areas of the supply pump, to the housing body.

The drawer may include a drawer body configured to be withdrawable from the cabinet through the exit port and a rear through hole formed through a rear surface of the drawer body. The connection pipe may be inserted into the rear through hole and connected to the discharger.

The first pump fastener may include a fastening protrusion protruding from an upper surface of the supply pump, a cover bracket protruding from the cover toward the fastening protrusion, and a protrusion receiving portion that is disposed on the cover bracket and to which the fastening protrusion is detachably coupled.

The second pump fastener may include a bracket protruding from the supply pump and a bolt configured to fix the bracket to the housing body.

The laundry treatment apparatus may further include a mounting portion fixed to the housing body and configured to surround a lower region of a horizontal line passing through a center of the connection pipe out of a circumferential surface of the connection pipe and a connection pipe supporter protruding from the circumferential surface of the connection pipe to maintain a gap between the connection pipe and the mounting portion.

The laundry treatment apparatus may further include a mounting portion fixed to the housing body and provided in a pipe shape surrounding the connection pipe and a connection pipe supporter protruding from a circumferential surface of the connection pipe to maintain a gap between the connection pipe and the mounting portion.

The conveyor portion may include a cylinder configured to have a hollow cylindrical shape and fixed to the connecting pipe, a communication hole configured to connect an inside of the connection pipe and an inside of the cylinder, a piston provided to reciprocate within the cylinder, a case fixed to any one of the cylinder or the connection pipe, and a driver disposed inside the case to provide power for allowing the piston to reciprocate within the cylinder. The connection pipe may include a first check valve located between the discharger and the communication hole out of an inner space of the connection pipe and configured to operate only in a direction of introducing liquid detergent into the connection pipe and a second check valve located between the communication hole and the supply pipe out of the inner space of the connection pipe and configured to operate only in a direction of discharging liquid detergent inside the connection pipe to the supply pipe.

The first pump fastener may include a fastening protrusion disposed on an upper surface of the case, a cover bracket protruding from the cover toward the fastening protrusion and a protrusion receiving portion that is disposed on the cover bracket and to which the fastening protrusion is detachably coupled.

The second pump fastener may include a bracket protruding from a circumferential surface of the connection pipe and a bolt configured to fix the bracket to the housing body.

The laundry treatment apparatus may further include a third pump fastener disposed between the first pump fastener and the second pump fastener to fix the supply pump to the housing, and the third pump fastener may include a second bracket protruding from a circumferential surface of the cylinder and a second bolt configured to fix the second bracket to the housing body.

The laundry treatment apparatus may further include a mounting portion provided in a pipe shape surrounding the connection pipe and fixed to the housing body and a connection pipe supporter protruding from a circumferential surface of the connection pipe to maintain a gap between the connection pipe and the mounting portion.

The laundry treatment apparatus may further include a first chamber disposed in the drawer to provide a space in which detergent is stored, a first through hole configured to discharge detergent inside the first chamber to the housing body, a tub connection pipe configured to connect the housing body and the tub body, a first flow path disposed inside the cover to supply water to the first chamber, and a first water supply pipe configured to connect the first flow path and a water supply source.

The laundry treatment apparatus may further include a second chamber disposed in the drawer, a second through hole formed through a bottom surface the second chamber to allow an inside of the second chamber to communicate with the housing body, a tub connection pipe configured to connect the housing body and the tub body, a chamber body configured to be detachable from the second chamber to provide a space in which liquid detergent is stored, an upper surface of the chamber body being open, a chamber discharger formed through a bottom surface of the chamber body, a siphon forming portion configured to move liquid inside the chamber body to the chamber discharger when a water level inside the chamber body becomes a preset reference water level, a second flow path disposed inside the cover to supply water to the chamber body, and a second water supply pipe configured to connect the second flow path and a water supply source.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementations of the disclosure and together with the description serve to explain the principle of the disclosure. In the drawings.

DETAILED DESCRIPTION

Reference will now be made in detail to various implementations of a laundry treatment apparatus, examples of which are illustrated in the accompanying drawings. It should be noted herein that construction of an apparatus, which will hereinafter be described, and a control method of the apparatus are given only for illustrative purposes and implementations are not limited thereto. Wherever possible, the same reference numbers will be used throughout the drawings to refer to the same or like parts.

Figure 1:
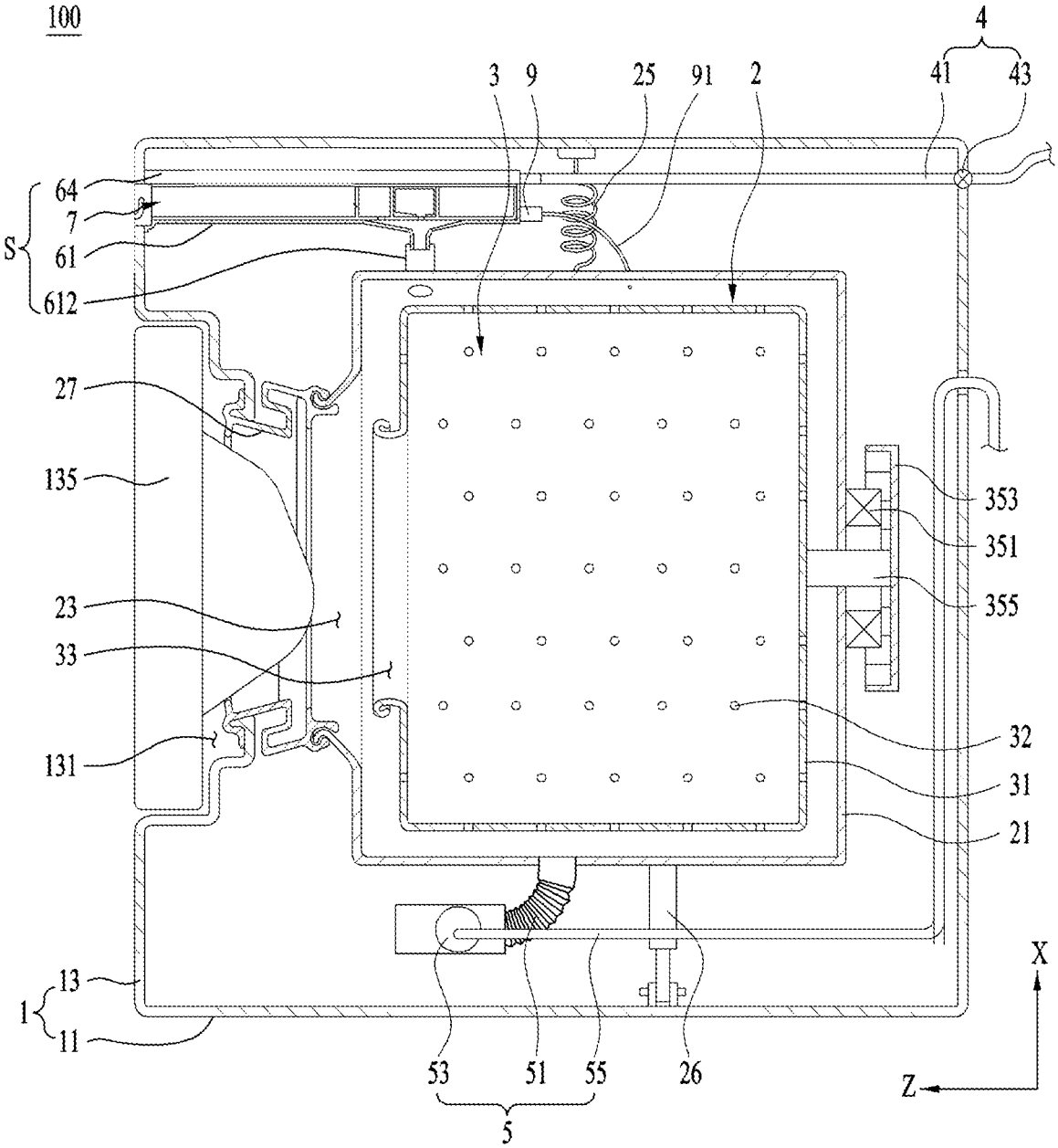
FIG. 1 illustrates an example of a laundry treatment apparatus.

As shown in FIG. 1, a laundry treatment apparatus 100 includes a cabinet 1, a tub 2 disposed inside the cabinet 1 to provide a space in which water is stored, a drum 3 rotatably disposed inside the tub 2 to store laundry, and a detergent supply portion S supplying detergent to the tub 2.

The cabinet 1 may include a base panel 11 forming the bottom surface of the laundry treatment apparatus 100 and a front panel 13 forming the front surface of the laundry treatment apparatus 100. The front panel 13 may be fixed to the base panel 11. The front panel 13 is provided with an introduction port 131 allowing the interior of the cabinet 1 to communicate with the exterior of the cabinet 1. The introduction port 131 may be configured to be opened and closed by a door 135 rotatably disposed on the front panel 13.

The tub 2 may be provided with a tub body 21 of a hollow cylindrical shape. The tub body 21 is provided on the front surface thereof with a tub introduction port 23. The tub introduction port 23 is coupled to the introduction port 131 through an insulating portion 27. The insulating portion 27 may be provided with an insulating body of a pipe shape that is made of an elastic member (e.g., rubber) and connects the introduction port 131 and the tub introduction port 23. The insulating portion 27 not only prevents water stored in the tub body 21 from being discharged to the cabinet 1 through the tub introduction port 23 but also attenuates the vibration of the tub body 21 transmitted to the cabinet 1.

The tub body 21 may be fixed to the inside of the cabinet 1 through a tub supporter. The tub supporter may include a spring 25 that fixes an area above a horizontal line passing through the rotational center of the drum 3 out of the circumferential surface of the tub body 21 to the cabinet 1, and a damper 26 that fixes an area under the horizontal line passing through the rotational center of the drum 3 out of the circumferential surface of the tub body 21 to the base panel 11.

The drum 3 is provided with a drum body 31 rotatably disposed inside the tub body 21. The drum body 31 has a hollow cylindrical shape and drum through holes 32 are provided on the circumferential surface, front surface, and rear surface of the drum body 31 to allow the interior of the drum body 31 to communicate with the interior of the tub body 21. A drum introduction port 33 is provided on a surface (front surface of the drum 3) toward the introduction port 131 among the surfaces provided by the drum body 31.

The drum body 31 is rotated by a drum driver. The drum driver includes a stator 351 fixed to the rear surface of the tub body 21 to generate a rotating magnetic field, a rotor 353 disposed outside the tub body 21 to rotate by the rotating magnetic field, and a rotating shaft 355 formed through the rear surface of the tub body 21 so as to connect the rotor 353 and the rear surface of the drum body 31.

The laundry treatment apparatus 100 may supply water to the tub body 21 through a water supplier 4 and discharge water inside the tub body 21 to the outside of the cabinet 1 through a drain portion 5.

The water supplier 4 may include a water supply pipe 41 for connecting the tub body 21 and a water supply source (not shown) and a valve 43 for controlling opening and closing of the water supply pipe 41. When the detergent supply portion S is provided to communicate with the tub body 21, the water supply pipe 41 may be configured to supply water to the detergent supply portion S. The number of water supply pipes 41 may be plural according to the structure of the detergent supply portion S.

The drain portion 5 includes a drain pump 53, a first drain pipe 51 guiding water in the tub body 21 to the drain pump 53, and a second drain pipe 55 guiding water discharged from the drain pump 53 to the outside of the cabinet 1.

Figure 2:
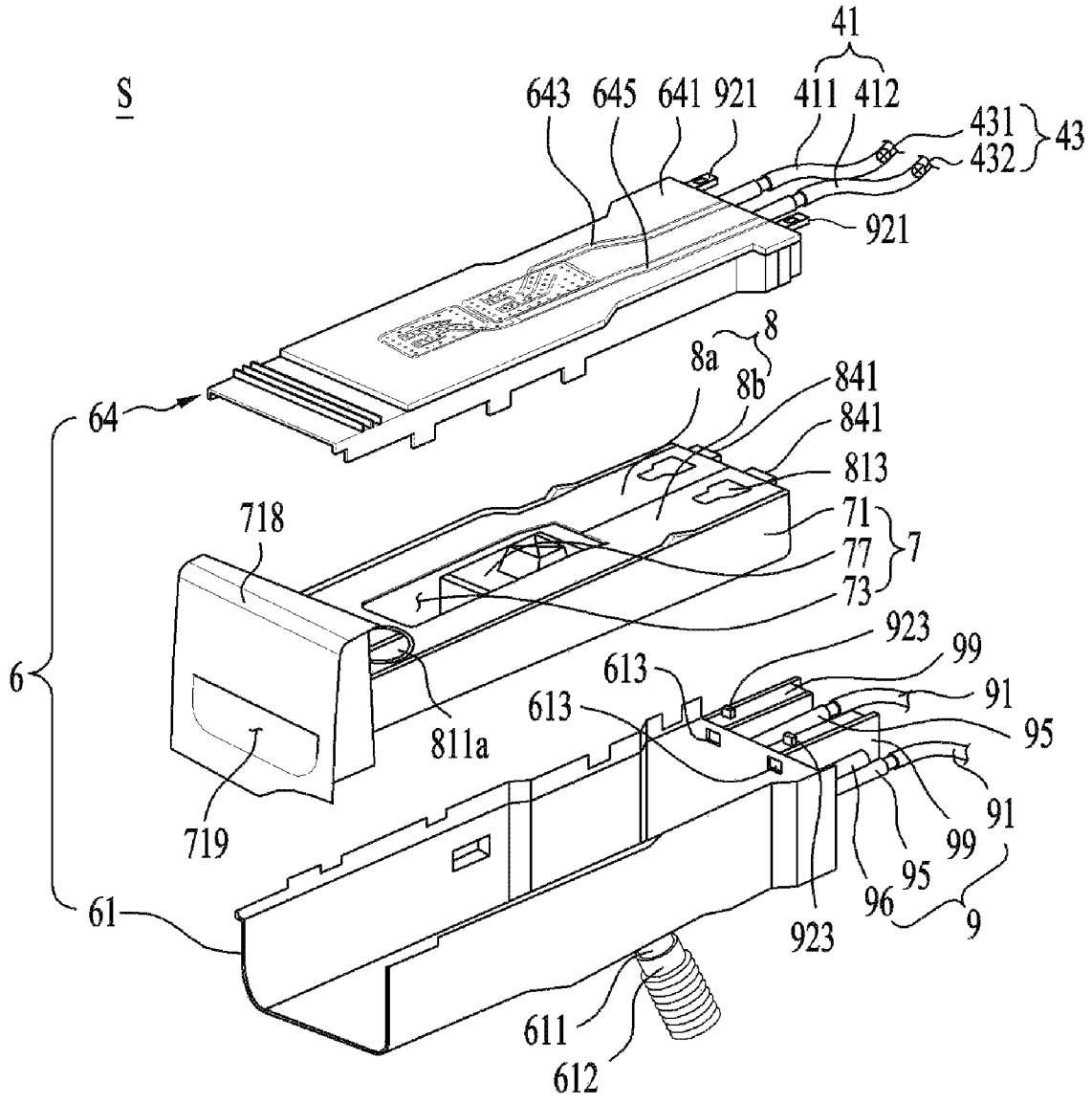
FIGS. 2, 3, and 4 illustrate an example of a detergent supply portion.

As shown in FIG. 2, the detergent supply portion S may include a housing 6 disposed inside the cabinet 1 to communicate with the tub body 21, a drawer 7 configured to be withdrawable from the housing 6 to provide a space in which detergent is stored, a storage portion 8 detachably disposed in the drawer 7 to store liquid detergent, and a supply pump 9 supplying the detergent stored in the storage portion 8 to the tub body 21.

Figure 3:
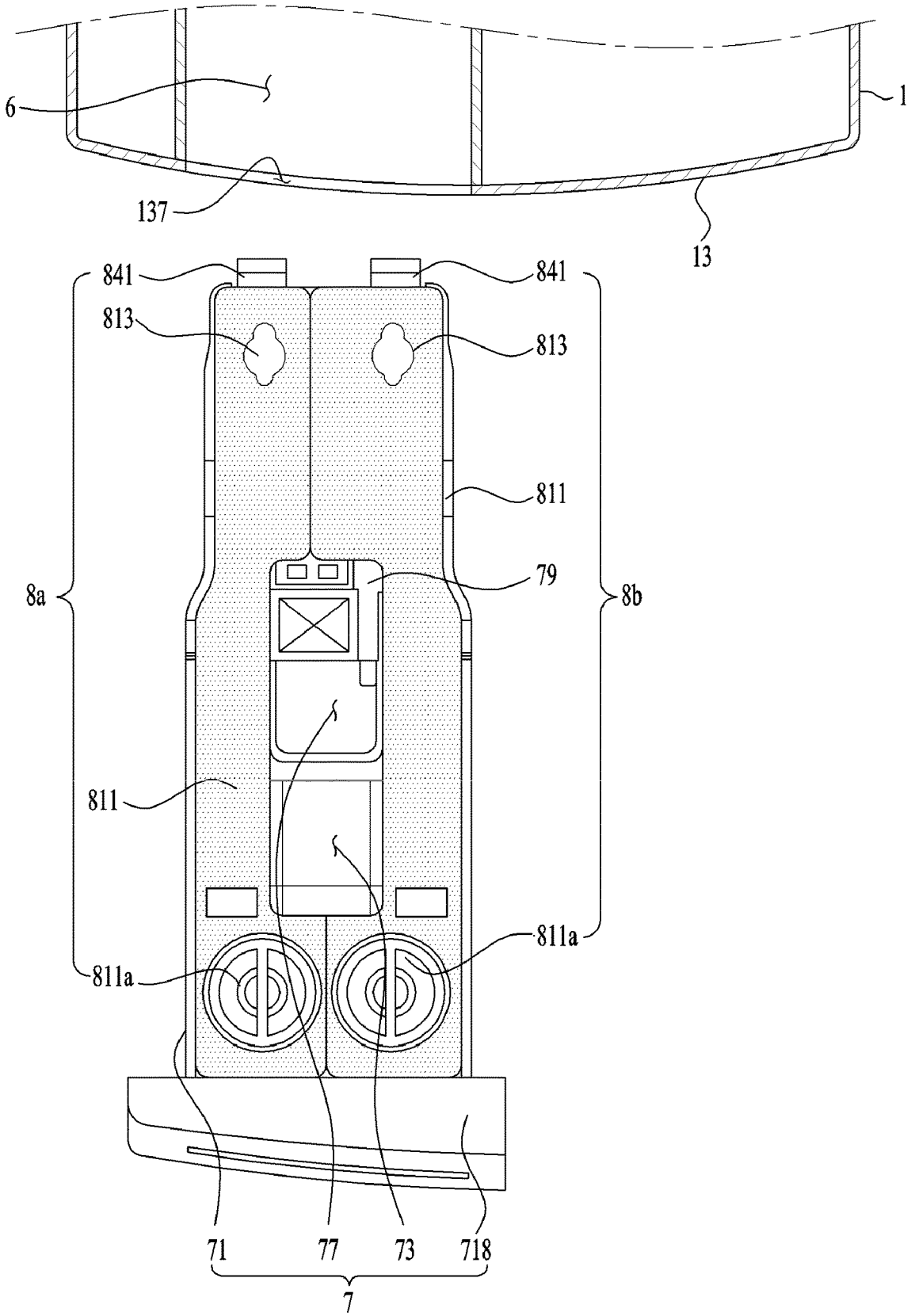

As shown in FIG. 3, the front panel 13 of the cabinet 1 may be provided with a (drawer) exit port 137. In this case, the inner space of the housing 6 is configured to communicate with the exit port 137 and the drawer 7 may be withdrawn to the outside of the cabinet 1 through the exit port 137.

The housing 6 may be configured in any shape or structure as long as it is possible to provide a space in which the drawer 7 is accommodated. FIG. 1 shows an example in which the housing 6 includes a housing body 61 that communicates with the exit port 137 and is provided in a shape accommodating the bottom surface, right surface, and rear surface of the drawer 7 and a cover 64 configured to form the upper surface of the housing body 61.

That is, as shown in FIG. 2, the housing body 61 may have a hexahedral shape with an open front surface and an open upper surface and the cover 64 may be configured to form the upper surface of the housing body 61.

The housing body 61 includes a body discharger 611 formed through the bottom surface thereof and a tub connection pipe 612 connecting the body discharger 611 and the tub body 21. Accordingly, water or detergent inside the housing body 61 may be moved to the tub body 21 through the body discharger 611 and the tub connection pipe 612.

The cover 64 includes a cover body 641 fixed to the housing body 61 to form the upper surface of the housing 6. A flow path for supplying water to the drawer 7 accommodated in the housing 6 may be disposed inside the cover body 641. FIG. 2 shows an example in which the flow path includes a first flow path 643 and a second flow path 645.

In this case, the water supply pipe 41 of the water supplier 4 includes a first water supply pipe 411 connecting the first flow passage 643 to the water supply source and a second water supply pipe 412 connecting the second flow passage 645 to the water supply source. The valve 43 of the water supplier 4 includes a first valve 431 that opens and closes the first water supply pipe 411 according to a control signal of a controller (not shown) and a second valve 432 that opens and closes the second water supply pipe 412 according to a control signal of the controller.

The drawer 7 includes a drawer body 71 that is configured to be insertable into the housing 6 and is withdrawable from the housing 6 through the exit port 137 and at least one chamber 73, 75, and 77 disposed in the drawer body 71 to provide a space in which detergent is stored.

Figure 4:
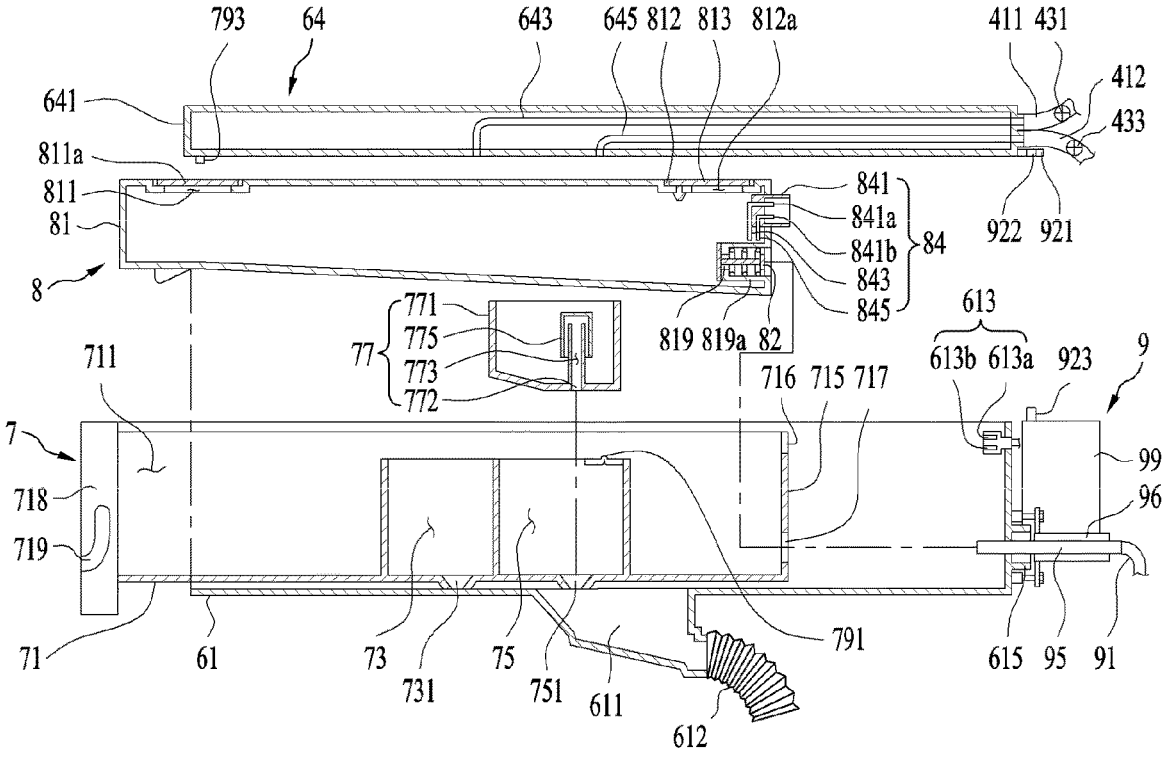

As shown in FIG. 4, the drawer body 71 is provided with an accommodation space 711 formed therein and has a hexahedral shape, the upper surface of which is open. The chamber may include at least one of a first chamber 73 or a second chamber 75 fixed to the bottom surface of the drawer body 71 to provide a space in which detergent is stored or a third chamber 77 configured to be detachable from the second chamber 75 to provide a space in which liquid detergent is stored. The first chamber 73 may receive water through the first flow path 643 and the third chamber 77 may receive water through the second flow path 645.

The drawer body 71 may be provided on the front surface thereof with a panel 718. The panel 718 may have a sufficient size to close the exit port 137 and may be provided with a handle 719 having a shape into which a user hand is insertable.

A first rear through hole 716 and a second rear through hole 717 may be disposed on a rear surface 715 of the drawer body 71. The first rear through hole 716 may be disposed on the upper end of the rear surface 715 and the rear second through hole 717 may be disposed on the lower end of the rear surface 715. The first rear through hole 716 and the second rear through hole 717 are spaces for a water level detector 87 and a discharger 819 disposed in the storage portion 8, which will be described in detail later.

The first chamber 73 is configured to communicate with the housing body 61 through a first through hole 731 formed through the bottom surface of the drawer body 71 (the bottom surface of the accommodation body 711). Accordingly, water supplied to the first chamber 73 through the first flow path 643 may be moved to the housing body 61 through the first through hole 731. The second chamber 75 is configured to communicate with the housing body 61 through a second through hole 751 formed through the bottom surface of the accommodation space 711.

The third chamber 77 may include a chamber body 771 provided to be detachable from the second chamber 75 to provide a space in which liquid detergent is stored, a chamber discharger 772 formed through the bottom surface of the chamber body 771, and a siphon forming portion moving liquid inside the chamber body 771 to the chamber discharger 772 when a water level inside the chamber body 771 becomes a preset reference water level.

The chamber body 771 may have a hexahedral shape, the upper surface of which is open. The siphon forming portion may include a chamber discharge pipe 773 extended from the chamber discharger 772 toward the cover 64 and a cap 775 accommodating a free end of the chamber discharge pipe 773 so as to form a siphon trap. If a water level inside the third chamber 77 rises up to the height of the free end of the chamber discharge pipe 773, liquid (mixture of water and detergent) inside the third chamber 77 is moved to the housing body 61 through the chamber discharger 772 and the second through hole 751.

As shown in FIG. 3, at least one of the drawer 7 or the housing 6 may further include a stopper 79 that limits the withdrawal distance of the drawer body 71 when the drawer body 71 is withdrawn from the cabinet 1. The stopper 79 should be disposed at a position at which the first chamber 73 and the third chamber 77 may be exposed to the outside of the cabinet 1. FIG. 4 is an example in which the stopper 79 includes a stopper body 791 fixed to the upper end of the second chamber 75 and a body fastener 793 disposed on the cover of the housing 6 to limit the movement of the stopper body 791.

The stopper 79 should be provided with a structure in which the drawer body 71 is separated from the cabinet 1 when a user pulls the drawer body 71 with force greater than or equal to preset force (force that transforms the stopper 79). Therefore, an example is illustrated in FIG. 4 in which the stopper body 791 is fixed to the upper end of the second chamber 75 and is provided with a stopper protrusion disposed on the upper surface thereof to contact the body fastener 793 according to the position of the drawer body 71.

As shown in FIG. 3, the storage portion 8 may include a first storage portion 8*a* and a second storage portion 8*b* that are detachable from the drawer body 71 and store liquid detergent therein. The first storage portion 8*a* and the second storage portion 8*b* may form detergent storage spaces separated from each other and may be formed in any shape or with any structure unless water supplied from the flow paths 643 and 645 of the cover 64 is hindered from being supplied to the first chamber 73 and the second chamber 75. The first storage portion 8*a* and the second storage portion 8*b* may have the same structure and the volume of the first storage portion 8*a* and the volume of the second storage portion 8*b* may be set differently from each other.

As shown in FIG. 4, each of the storage portions 8*a* and 8*b* includes a storage body 81 that is detachable from the drawer body 71 and stores liquid detergent therein. The storage body 81 may be provided on the upper surface thereof with a supply port 811 into which liquid detergent is injected and a supply port lid 811*a* opening and closing the supply port 811.

Figure 5:
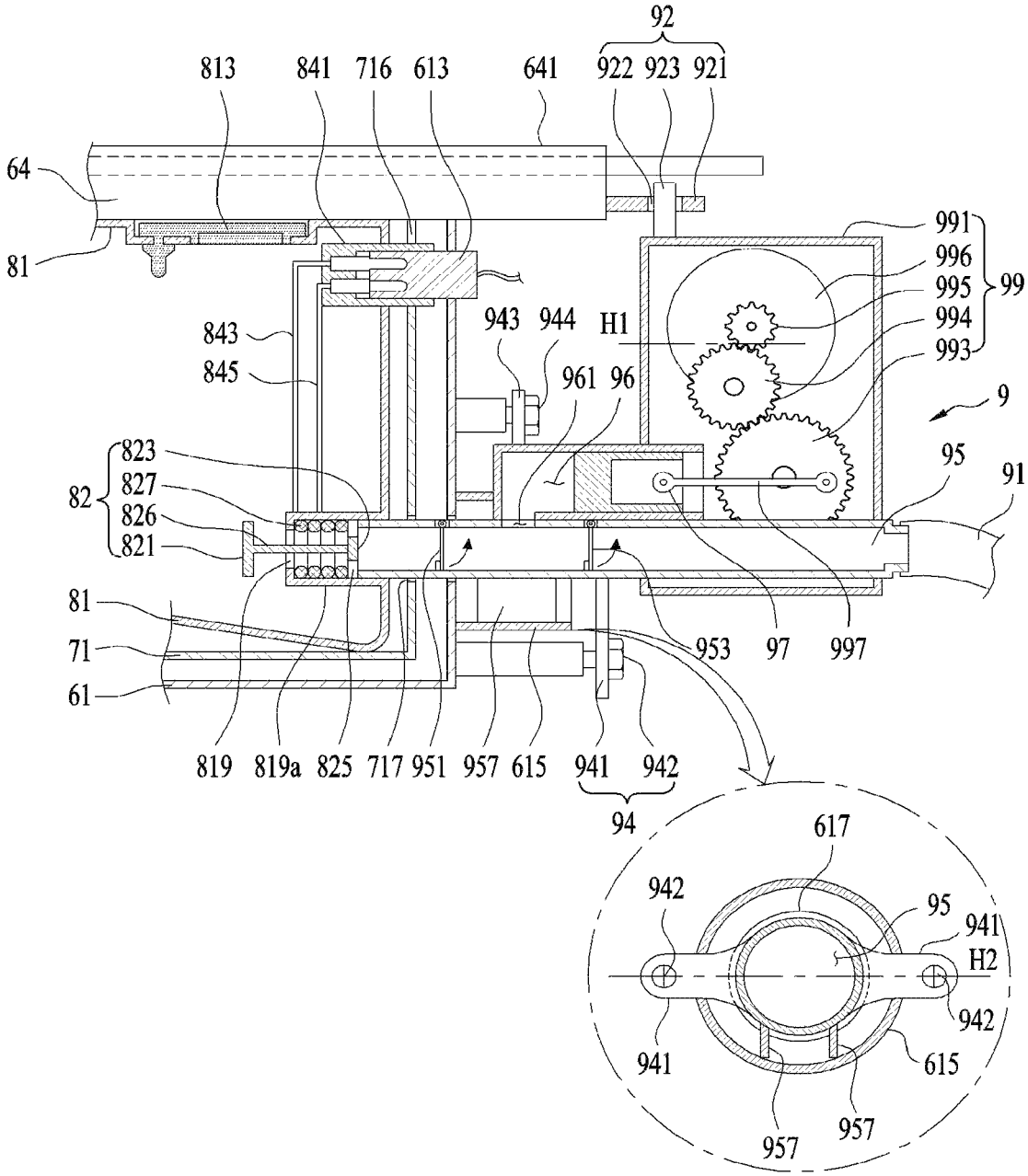
FIG. 5 illustrates an example of the detergent supply portion.

As shown in FIG. 5, the storage body 81 may be provided on the rear surface thereof with the discharger 819 from which detergent inside the storage body 81 is discharged and a discharge valve 82 opening or closing the discharger 819. The discharger 819 should be provided so as to be located at the second rear through hole 717 when the storage body 81 is inserted into the drawer body 71. The discharge valve 82 may be formed to open or close the discharger 819 by a connection pipe 95 of the supply pump 9.

The storage body 81 is provided on the rear surface thereof with a fastener 819*a* into which the connection pipe 95 of the supply pump 9 is inserted. The fastener 819*a* may be provided with a groove formed in such a manner that the rear surface of the storage body 81 is concavely bent. The discharger 819 and the discharge valve 82 may be disposed inside the fastener 819*a*.

The discharge valve 82 may include a first valve body 821 provided in a shape capable of closing the discharger 819 and located inside the storage body 81, a second valve body 823 located inside the fastener 819*a*, a valve body through hole 825 formed through the second valve body 823, a connection bar 826 inserted into the discharger 819 and configured to connect the two valve bodies 821 and 823, and a spring 827 disposed on the fastener 819*a* to allow the first valve body 821 to maintain a state of closing the discharger 819.

In order to minimize residual liquid detergent inside the storage body 81, the bottom surface of the storage body 81 may be inclined downward from the supply port 811 toward the discharger 819. In this case, the storage body 81 may further include a protrusion for maintaining a gap between the bottom surface of the storage body 81 and the bottom surface of the drawer body 71.

In order to sense the amount of detergent stored in the storage body 81, the storage portion 8 may further include a water level sensor 84. As shown in FIG. 4, the water level sensor 84 may include a first electrode 843 and a second electrode 845 each having an end located inside the storage body 81 and the other end exposed to the outside of the storage body 81. The first electrode 843 and the second electrode 845 are separated from each other.

The first electrode 843 and the second electrode 845 may be fixed to the rear surface of the storage body 81 through a fixing portion 841. The fixing part 841 is provided with a first connection terminal 841*a* and a second connection terminal 841*b* formed of a conductive material. The first electrode 843 is connected to the first connection terminal 841*a* so that one end thereof is exposed to the outside of the storage body 81, and the second electrode 845 is connected to the second connection terminal 841*b* so that one end thereof is exposed to the outside of the storage body 81.

If the storage body 81 is inserted into the drawer body 71, the fixing portion 841 is inserted into the first rear through hole 716 so that the fixing portion 841 is exposed to the outside of the drawer body 71. Accordingly, even if the storage body 81 is inserted into the drawer body 71, the first connection terminal 841*a* and the second connection terminal 841*b* are exposed to the outside of the drawer body 71.

The first electrode 843 and the second electrode 845 are connected to a power source through an electrode coupler 613 fixed to the housing body 61. The electrode coupler 613 includes a first terminal 613*a* coupled to the first connection terminal 841*a* and a second terminal 613*b* coupled to the second connection terminal 841*b*. Therefore, if the drawer body 71 is inserted into the housing 6, the first electrode 843 and the second electrode 845 are connected to the power source through the terminals 841*a*, 841*b*, 613*a*, and 613*b* and, if the drawer body 71 is withdrawn from the housing 6, the first electrode 843 and the second electrode 845 are separated from the power source.

If current is supplied to the first electrode 843 while a free end of the first electrode 843 and a free end of the second electrode 845 located inside the storage body 71 are in contact with liquid detergent, current will pass to the second electrode 845 through the liquid detergent. Accordingly, the controller (not shown) may determine whether the liquid detergent is present in the storage body 71 by sensing whether current flows into the second electrode 845.

The free end of the first electrode 843 and the free end of the second electrode 845 may be positioned between the highest point of the discharger 819 and the highest point of the fastener 819*a*. When a water level inside the storage body 81 is lower than the lowest point of the discharger 819, it is difficult to discharge liquid detergent inside the storage body 81 to the outside of the storage body 81 through the discharger 819. Accordingly, if the two electrodes 843 and 845 are provided as described above, the controller may determine a time point at which the storage body 81 should be replenished with liquid detergent.

Further, the cabinet 1 may be provided with a notification portion (a display, a speaker, etc.) and the controller may control the notification portion to output a signal requesting replenishment of liquid detergent. The laundry treatment apparatus 100 having the above-described controller and notification portion may determine the timing of replenishment of the liquid detergent and may make a request for replenishment of liquid detergent to the user.

Since liquid detergent stored in the storage body 81 has higher viscosity than water, there is a possibility that liquid detergent or foreign substances remain on the surface of the first electrode 843 and the surface of the second electrode 845. If the liquid detergent or foreign substances remain on the surfaces of the electrodes 843 and 845, the laundry treatment apparatus 100 may fail to sense a water level inside the storage body 81.

The storage body 81 may further include a cleaning hole 812*a* and a lid 813 that opens and closes the cleaning hole 812*a* so that the user may remove the foreign substances remaining on the surfaces of the electrodes 843 and 845.

The cleaning hole 812*a* may be disposed at any position of the storage body 71 as long as the first electrode 843 and the second electrode 845 are identifiable from the outside of the storage body 71. FIG. 4 illustrates an example of the position of the cleaning hole 812*a* when the electrode coupler 613 is disposed on one surface (the rear surface of the housing body 61) toward the rear surface 715 of the drawer 7 among surfaces provided by the housing body 61.

That is, when the electrode coupler 613 is disposed on the rear surface of the housing body 61, the cleaning hole 812*a* may be disposed at a point between the stopper 79 and the rear surface 715 of the drawer body 71 out of the upper surface of the storage body 81. This serves to minimize the risk of losing the lid 813 by preventing the cleaning hole 812*a* from being exposed to the outside unless the user removes the drawer 7 from cabinet 1 for cleaning the electrodes.

Figure 6:
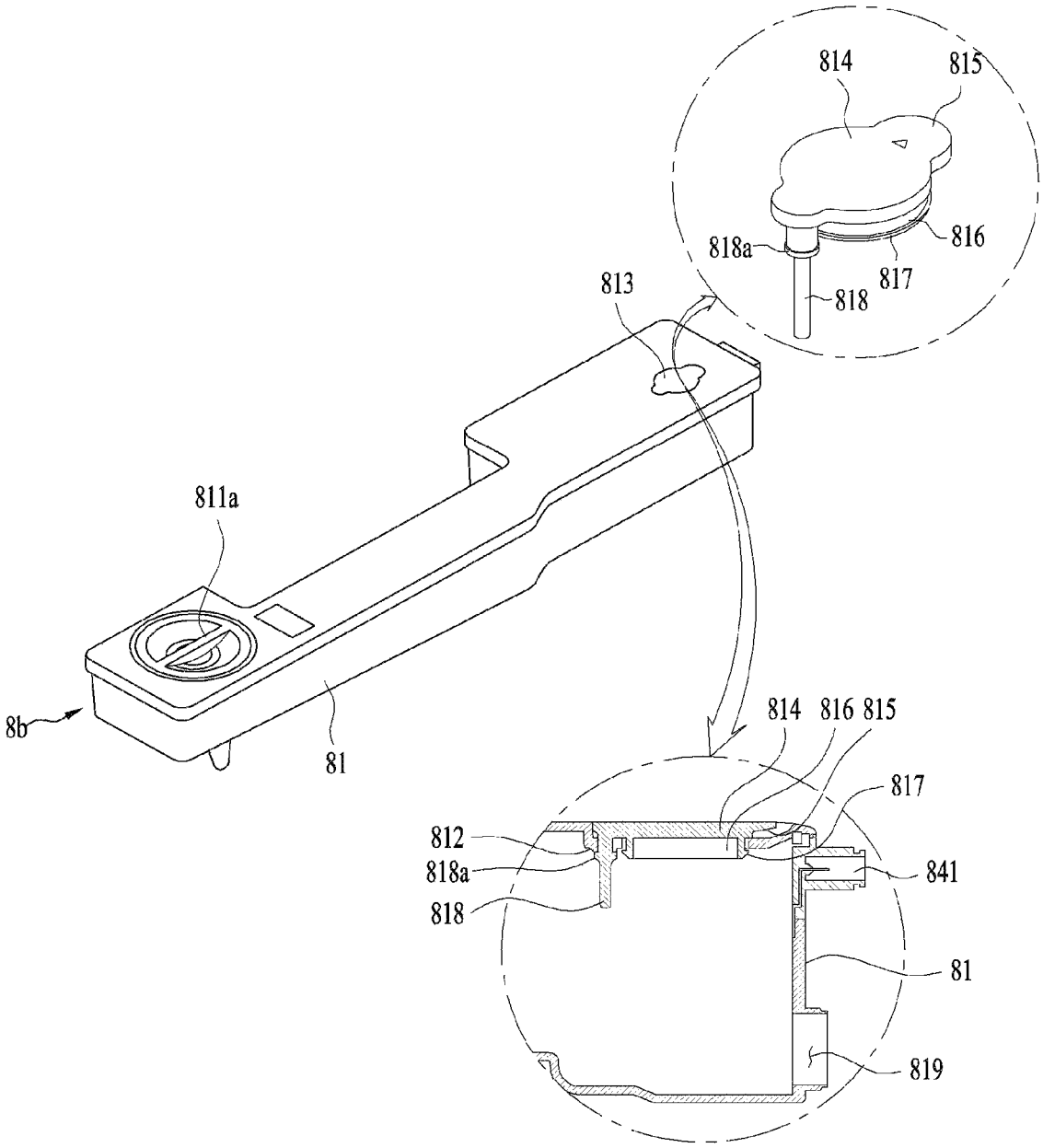
FIGS. 6 and 7 illustrate an example of a storage portion.

As shown in FIG. 6, a lid receiving groove 812 providing a space in which the lid 813 is accommodated may be further disposed on the upper surface of the storage body 81. The lid receiving groove 812 may be provided with a groove formed such a manner that the upper surface of the storage body 81 is concavely bent toward the bottom surface of the storage body 81. If the lid 813 maintains a state of protruding from the upper surface of the storage body 81, the distance between the upper surface of the storage body 81 and the cover 84 increases (the volume of the housing increases). The lid receiving groove 812 is a means for minimizing such a disadvantage (a means for minimizing the volume of the housing).

The lid 813 may be formed of an elastic material such as rubber. The lid 813 may include a lid body 814 that closes the cleaning hole 812*a* and a rotating shaft 818 that rotatably fixes the lid body 814 to the storage body 81. The thickness of the lid body 814 is set to be less than the depth of the lid receiving groove 812. The rotating shaft 818 may be provided to be inserted into a shaft through hole that is formed through the upper surface of the storage body 81 and is located in the lid receiving groove 812.

The lid 813 may further include an insertion tube 816 provided in a pipe shape protruding from the lid body 814 and inserted into the cleaning hole 812*a* and an insertion tube protrusion 817 maintaining a coupled state of the insertion tube 816 to the cleaning hole 812*a*. The insertion tube protrusion 817 may desirably be disposed in a region located inside the storage body 81, out of the circumferential surface of the insertion tube 816, when the lid body 814 closes the cleaning hole 812*a*.

A shaft protrusion 818*a* is further disposed on the circumferential surface of the rotating shaft 818. The shaft protrusion 818*a* is desirably provided in a region located inside the storage body 81 out of the circumferential surface of the rotating shaft 818. In addition, the shaft protrusion 818*a* may be formed in a ring shape surrounding the circumferential surface of the rotating shaft 818 and the diameter of the shaft protrusion 818*a* may be set to be longer than the diameter of the shaft through hole.

The lid body 814 may be provided with a lid handle 815 on the edge of the circumferential surface thereof so that the user may easily rotate the lid body 814 in a direction of opening the cleaning hole 812*a* or easily rotate the lid body 814 around the rotating shaft 818. The lid handle 815 may protrude from the edge of the circumferential surface of the lid body 814 and the thickness of the lid handle 815 may be set to become thinner as the distance from the lid body 814 increases.

If the thickness of the lid handle 815 is set to become thinner toward the free end of the lid handle 815, a gap between the lid handle 815 and the lid receiving groove 812 becomes wider toward the free end of the lid handle 815, so that the user may more easily hold the handle 815.

Figure 7:
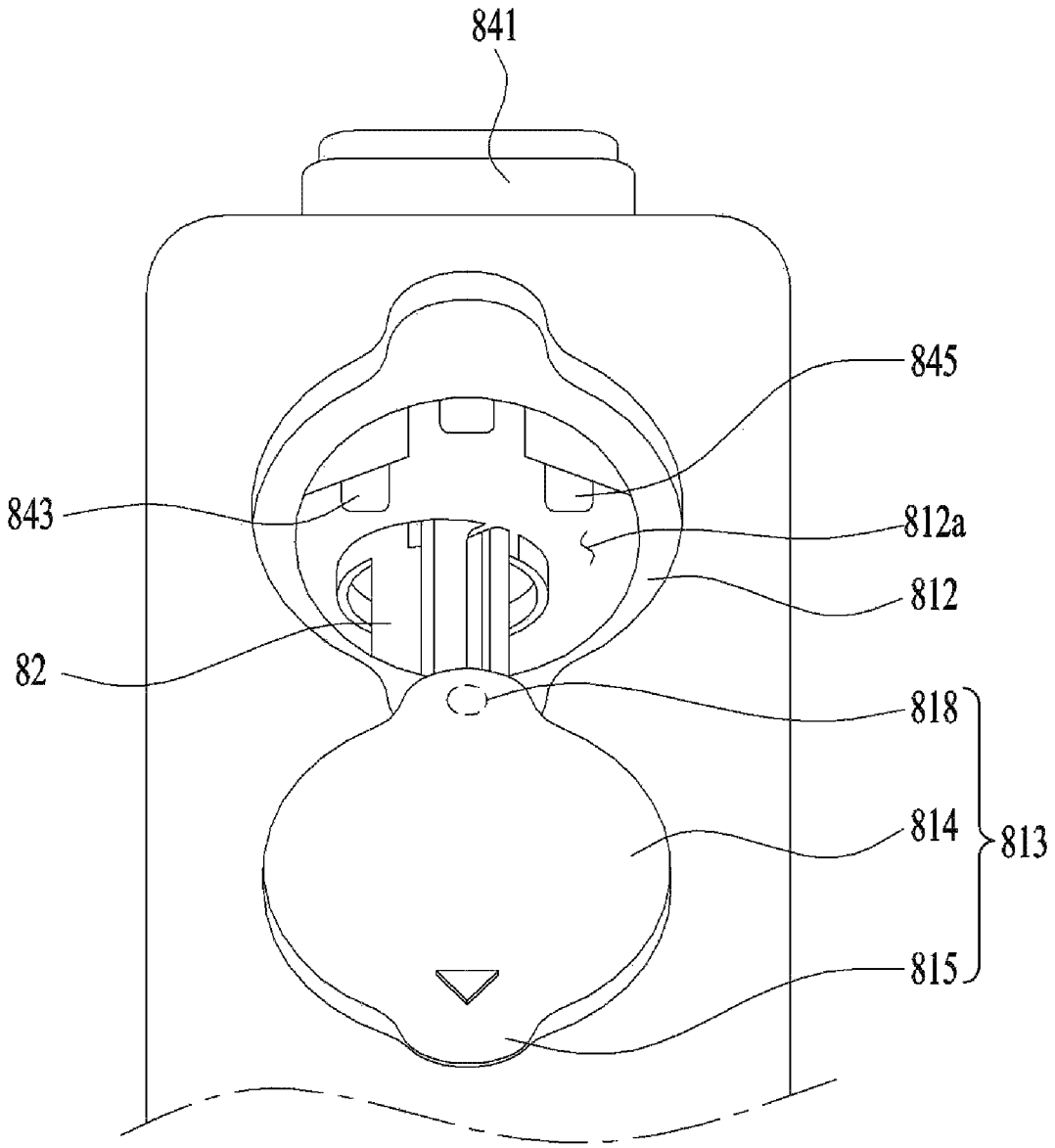

FIG. 7 shows a state in which the cleaning hole 812*a* is opened to clean the first electrode 843 and the second electrode 845. When it is necessary to clean the first electrode 843 and the second electrode 845, the user may lift the lid body 814 in a direction of opening the cleaning hole 812*a* and then rotate the lid body 814 around the rotation axis 818.

Even while the cleaning hole 812*a* remains open, since the lid body 814 maintains a state of being fixed to the storage body 81 through the rotating shaft 818, the laundry treatment apparatus 100 minimizes the risk of losing the lid body 814. When the cleaning hole 812*a* is opened, the first electrode 843 and the second electrode 845 are exposed to the outside of the storage body 81, so that the user may clean the surfaces of the electrodes using a brush or the like.

As shown in FIG. 5, the supply pump 9 may include a connection pipe 95 formed through the housing body 61 and connected to the discharger 819 when the drawer body 71 is inserted into the housing 6, a supply pipe 91 connecting the connection pipe 95 and the tub body 21, and a conveyor portion conveying detergent inside the storage body 81 to the supply pipe 91.

The connection pipe 95 may be formed of a pipe that is inserted into a housing through hole 617 formed through the rear surface of the housing body 61 and has one end inserted into the fastener 819*a* and the other end connected to the supply pipe 91.

The conveyor portion may include a cylinder 96 of a hollow cylindrical shape fixed to the connecting pipe 95, a piston 97 provided to reciprocate within the cylinder 96, and a driver 99 generating power for allowing the piston 97 to reciprocate within the cylinder 96. The cylinder 96 is connected to the inside of the connection pipe 95 through a communication hole 961.

The driver 99 includes a case 991 fixed to at least one of the connection pipe 95 or the cylinder 96, gears 993, 994, and 995 arranged in an installation space provided inside the case 991, a motor 996 disposed in the installation space to rotate the gears 993, 994, and 995, and a link 997 connecting the gears 993, 994, and 995 to the piston 97.

The gears may be provided in various numbers according to the reciprocating cycle of the piston 97. FIG. 5 shows an example in which the gears include a first gear 993 connected to the piston 97 through the link 997, a second gear 995 rotated by the motor 996, and a connection gear 994 transmitting the power of the second gear 995 to the first gear 993.

One end of the link 997 is rotatably coupled to the piston 97 and the other end of the link 997 is rotatably coupled to the first gear 93. Accordingly, the rotational motion of the first gear 93 is converted into linear reciprocating motion of the piston 97 by the link 997.

When the conveyor portion is provided as described above, the connection pipe 95 is provided with a first check valve 951 and a second check valve 953. The first check valve 951 is located between the discharger 819 and the communication hole 961 out of the inner space of the connection pipe 95 and is provided to operate only in a direction of introducing liquid detergent into the connection pipe 95. The second check valve 953 is located between the communication hole 961 and the supply pipe 91 out of the inner space of the connection pipe 95 and is provided to operate only in a direction of discharging the liquid detergent inside the connection pipe 95 to the supply pipe 91.

When the drawer body 71 is inserted into the housing 6 by the user, the connection pipe 95 is inserted into the fastener 819*a* through the second rear through hole 717 of the drawer body 71. If the connection pipe 95 is inserted into the fastener 819*a*, the first valve body 821 opens the discharger 819. If the discharger 819 is opened, liquid detergent inside the storage body 71 may be introduced into the connection pipe 95 through the discharger 819 and through the valve body through hole 825 disposed on the second valve body 823.

In such a state, when the piston 97 moves in a direction away from the communication hole 961, the first check valve 951 rotates in a direction in which the communication hole 961 is located to open the connection pipe 95 but the second check valve 953 maintains a state of closing the connection pipe 95. Accordingly, the liquid detergent discharged from the discharger 819 will be move up to a space between the first check valve 951 and the second check valve 953.

Thereafter, if the piston 97 is moved toward the communication hole 961, the first check valve 951 rotates in a direction of closing the communication hole 961 and the second check valve 953 rotates in a direction of opening the connection pipe 95. Accordingly, the liquid detergent present between the first check valve 951 and the second check valve 953 will be moved to the tub body 21 through the supply pipe 91.

Since the amount of liquid detergent supplied to the tub body 21 by one reciprocation of the piston 97 is constant, the controller may control the number of times of reciprocation of the piston 97 to control the amount of liquid detergent supplied to the tub body 21.

The supply pump 9 may desirably be fixed to the housing 6 through a first pump fastener 92 and a second pump fastener 94. This is because, in the detergent supply portion S having the above-described structure, the supply pump 9 may not perform a set function due to vibration generated during operation of the supply pump 9 unless the supply pump 9 is firmly fixed to the housing 6.

In order to firmly fix the supply pump 9 to the housing 6, the first pump fastener 92 may be provided to fix an area located above the connection pipe 95, among areas provided by the supply pump 9, to the cover 64, and the second pump fastener 94 may be provided to fix an area parallel to the connection pipe 95 or an area located under the connection pipe 95, among the areas provided by the supply pump 9, to the housing body 61.

Unlike the above example, in order to firmly fix the supply pump 9 to the housing 6, the first pump fastener 92 may be configured to fix an area located above a horizontal line H1 passing through the center of weight of the supply pump 9, among the areas provided by the supply pump 9, to the cover 64, and the second pump fastener 94 may be configured to fix an area located under the horizontal line H1, among the areas provided by the supply pump 9, to the housing body 61.

The first pump fastener 92 may include a fastening protrusion 923 protruding from the upper surface of the supply pump 9, a cover bracket 921 protruding from the cover 64 toward the fastening protrusion 923, and a protrusion receiving portion 922 that is disposed on the cover bracket 921 and to which the fastening protrusion 923 is detachably coupled. The protrusion receiving portion 922 may be provided with a hole formed through the cover bracket 921 in a penetrating manner or a groove formed in such a manner that the cover bracket 921 is concavely bent.

Unlike the example shown in FIG. 5, the first pump fastener 92 may include a fastening protrusion arranged on the cover 64, a pump bracket protruding from the upper surface of the supply pump 9 toward the fastening protrusion, and a protrusion receiving portion that is disposed on the pump bracket and to which the fastening protrusion is detachably coupled.

The second pump fastener 94 may include a bracket 941 (a first bracket) protruding from the supply pump 9 and a bolt 942 (a first bolt) fixing the bracket 941 to the housing body 61.

A third pump fastener fixing the supply pump 9 to the housing 6 may further be provided between the first pump fastener 92 and the second pump fastener 94. The third pump fastener may include a bracket 943 (a second bracket)

protruding from the circumferential surface of the cylinder 96 and a bolt 944 (a second bolt) fixing the second bracket 943 to the cover 64 or the housing body 61.

In order to further strengthen coupling of the supply pump 9 and the housing 6, the laundry treatment apparatus 100 may further include a mounting portion 615 provided in a pipe shape surrounding the connection pipe 95 and fixed to the housing body 61 and a connection pipe supporter 957 protruding from the circumferential surface of the connection pipe 95 to maintain a gap between the connection pipe 95 and the mounting portion 615. The connection pipe supporter 957 may be provided with a plurality of protrusions disposed on a lower region of a horizontal line H2 passing through the center of the connection pipe 95. Unlike an example illustrated in the figure, the mounting portion 615 may be provided in an arc shape surrounding only the lower region of the horizontal line H2 passing through the center of the connection pipe 95.

As described above, the present disclosure provides a laundry treatment apparatus that improves durability of a supply pump detachably disposed on a storage body in which detergent is stored.

In addition, the present disclosure provides a laundry treatment apparatus capable of sensing the amount of liquid detergent stored in the storage body.

Furthermore, the present disclosure provides a laundry treatment apparatus that makes it easy to clean a means for sensing the amount of liquid detergent.

The above-described laundry treatment apparatus may be modified in various manners and implemented. The scope of the laundry treatment apparatus is not limited to the above implementations.

What is claimed is:

1. A laundry treatment apparatus, comprising:

a cabinet that defines an introduction port and an exit port;

a tub disposed in the cabinet and configured to receive water, the tub defining a tub introduction port in communication with the introduction port of the cabinet;

a drum that is rotatably disposed inside the tub and defines a drum introduction port in communication with the tub introduction port;

a drawer configured to be withdrawn from and inserted into the exit port of the cabinet;

a housing disposed in the cabinet and configured to receive the drawer, the housing comprising a housing body configured to communicate with the exit port, and a cover disposed at an upper surface of the housing body;

a storage portion comprising:

a storage body configured to be detachably inserted into the drawer and to store liquid detergent therein, a discharger disposed at the storage body, and a discharge valve configured to open and close the discharger;

a supply pump comprising:

a connection pipe that passes through at least a portion of the housing body and is configured to connect to the discharger based on the drawer being inserted into the housing, a supply pipe that connects the connection pipe to the tub, and a conveyor portion configured to convey the liquid detergent in the storage body to the supply pipe;

a first pump fastener that couples a first portion of the supply pump to the cover, the first portion of the supply pump being located above the connection pipe; and a second pump fastener that couples a second portion of the supply pump to the housing body, the second portion of the supply pump being disposed below the connection pipe or extending parallel to the connection pipe.

2. The laundry treatment apparatus of claim 1, wherein the first pump fastener comprises:

a fastening protrusion that protrudes from an upper surface of the supply pump; and a cover bracket that protrudes from the cover toward the fastening protrusion and defines a protrusion receiving portion coupled to the fastening protrusion.

3. The laundry treatment apparatus of claim 2, wherein the second pump fastener comprises a bracket that protrudes from the supply pump, and a bolt that couples the bracket to the housing body.

4. The laundry treatment apparatus of claim 3, further comprising:

a mounting portion fixed to the housing body, the mounting portion being disposed below the connection pipe and spaced apart from a circumferential surface of the connection pipe; and a connection pipe supporter that protrudes from the circumferential surface of the connection pipe to the mounting portion to thereby maintain a gap between the connection pipe and the mounting portion.

5. The laundry treatment apparatus of claim 3, further comprising:

a mounting portion disposed at the housing body, the mounting portion having a pipe shape that surrounds a circumferential surface of the connection pipe and is spaced apart from the circumferential surface of the connection pipe; and a connection pipe supporter that protrudes from the circumferential surface of the connection pipe to the mounting portion to thereby maintain a gap between the connection pipe and the mounting portion.

6. The laundry treatment apparatus of claim 1, wherein the conveyor portion comprises:

a cylinder that has a hollow cylindrical shape and is fixed to the connection pipe, the cylinder defining a communication hole that communicates an inner space of the cylinder with an inside of the connection pipe;

a piston disposed in the cylinder and configured to reciprocate with respect to the cylinder;

a case fixed to at least one of the cylinder or the connection pipe; and a driver disposed inside the case and configured to supply power to the piston to reciprocate within the cylinder.

7. The laundry treatment apparatus of claim 6, wherein the connection pipe comprises:

a first check valve located in the inner space of the connection pipe and positioned between the discharger and the communication hole, the first check valve being configured to open in one direction to introduce the liquid detergent into the connection pipe; and a second check valve located in the inner space of the connection pipe and positioned between the communication hole and the supply pipe, the second check valve being configured to open in one direction to discharge the liquid detergent from the connection pipe to the supply pipe.

8. The laundry treatment apparatus of claim 7, wherein the first pump fastener comprises:

a fastening protrusion disposed at an upper surface of the case; and a cover bracket that protrudes from the cover toward the fastening protrusion and defines a protrusion receiving portion coupled to the fastening protrusion.

9. The laundry treatment apparatus of claim 8, wherein the second pump fastener comprises:

a bracket that protrudes from a circumferential surface of the connection pipe; and a bolt that fixes the bracket to the housing body.

10. The laundry treatment apparatus of claim 8, wherein the fastening protrusion extends through the protrusion receiving portion, and a width of the protrusion receiving portion is greater than a width of the fastening protrusion.

11. The laundry treatment apparatus of claim 8, further comprising:

a third pump fastener that is disposed between the first pump fastener and the second pump fastener and couples a third portion of the supply pump to the housing, the third pump fastener comprising a second bracket that protrudes from a circumferential surface of the cylinder, and a second bolt that couples the second bracket to the housing body.

12. The laundry treatment apparatus of claim 8, further comprising:

a mounting portion fixed to the housing body, the mounting portion having a pipe shape that surrounds a circumferential surface of the connection pipe and is spaced apart from the circumferential surface of the connection pipe; and a connection pipe supporter that protrudes from the circumferential surface of the connection pipe to the mounting portion to thereby maintain a gap between the connection pipe and the mounting portion.

13. The laundry treatment apparatus of claim 11, wherein the drawer defines:

a first chamber configured to store detergent; and a first through hole disposed at a bottom of the first chamber and configured to discharge the detergent in the first chamber to the housing body, wherein the cover defines a first flow path configured to supply water to the first chamber, and wherein the laundry treatment apparatus further comprises:

a tub connection pipe that connects the housing body to the tub, and a first water supply pipe that connects the first flow path to a water supply source.

14. The laundry treatment apparatus of claim 13, wherein the drawer further defines:

a second chamber; and a second through hole disposed at a bottom of the second chamber and configured to communicate with the housing body.

15. The laundry treatment apparatus of claim 14, further comprising:

a chamber body configured to be detachably inserted into the second chamber, the chamber body being configured to store liquid detergent and having an open upper surface;

a chamber discharger defined at a bottom surface of the chamber body; and a siphon forming portion configured to move the liquid detergent in the chamber body to the chamber discharger based on a liquid level in the chamber body corresponding to a preset reference level.

16. The laundry treatment apparatus of claim 15, wherein the cover defines a second flow path configured to supply water to the chamber body, and wherein the laundry treatment apparatus further comprises a second water supply pipe that connects the second flow path to the water supply source.

17. The laundry treatment apparatus of claim 15, wherein the storage portion comprises a first storage portion and a second storage portion that are configured to be inserted to the drawer and face each other, and wherein the first chamber is defined between the first storage portion and the second storage portion.

18. The laundry treatment apparatus of claim 17, wherein the second chamber is defined rearward relative to the first chamber.

19. The laundry treatment apparatus of claim 13, further comprising:

a chamber body configured to be detachably inserted into the first chamber, the chamber body being configured to store liquid detergent and having an open upper surface;

a chamber discharger defined at a bottom surface of the chamber body; and a siphon forming portion configured to move the liquid detergent in the chamber body to the chamber discharger based on a liquid level in the chamber body corresponding to a preset reference level.

20. The laundry treatment apparatus of claim 19, wherein the storage portion comprises a first storage portion and a second storage portion that are configured to be inserted to the drawer, and wherein side surfaces of the first storage portion and the second storage portion are configured to be spaced apart from each other to thereby define the first chamber between the first storage portion and the second storage portion in the drawer.

* * * * *